United States Patent [19]

Olson et al.

[11] Patent Number: 4,761,519

[45] Date of Patent: Aug. 2, 1988

[54] HIGHLY FLEXIBLE, SHIELDED, MULTI-CONDUCTOR ELECTRICAL CABLE

[75] Inventors: Ronald A. Olson, Portland; Arthur G. Buck, Sherwood, both of Oreg.

[73] Assignee: Precision Interconnect Corporation, Portland, Oreg.

[21] Appl. No.: 8,331

[22] Filed: Jan. 29, 1987

[51] Int. Cl.[4] ..... H01B 7/18; H01B 7/04

[52] U.S. Cl. ..... 174/107; 156/51; 156/53; 156/56; 174/109

[58] Field of Search ..... 174/107, 109, 13; 138/127; 156/51, 53, 56

[56] References Cited

U.S. PATENT DOCUMENTS

| | | | |
|---|---|---|---|
| 2,006,932 | 7/1935 | Rosch | 174/25 R |
| 2,234,675 | 3/1941 | Johnson | 174/27 |
| 2,277,177 | 3/1942 | Wermine | 174/107 |
| 2,866,843 | 12/1958 | Arman | 174/25 R |
| 3,275,739 | 9/1966 | Eager, Jr. | 174/107 |
| 3,665,096 | 5/1972 | Madle | 174/107 |
| 3,763,482 | 10/1973 | Burney et al. | 174/115 X |
| 3,921,125 | 11/1975 | Miller et al. | 174/107 X |
| 4,552,989 | 11/1985 | Sass | 174/107 X |

FOREIGN PATENT DOCUMENTS

| | | | |
|---|---|---|---|
| 126949 | 2/1948 | Australia | 174/107 |
| 1448820 | 9/1976 | United Kingdom | 174/109 |

*Primary Examiner*—Morris H. Nimmo

*Attorney, Agent, or Firm*—Chernoff, Vilhauer, McClung & Stenzel

[57] ABSTRACT

A highly flexible, shielded electrical cable having exceptional pliability and limpness is provided for connection to devices such as hand-held medical instruments to minimize the resistance to movement of such devices imposed by such cable. The normal stiffness of shielded cables caused by a braided wire shield is minimized by eliminating the frictional resistance to relative movement between the shield and the dielectric covering of the conductor assembly inside the shield. This is accomplished by loosely braiding the shield around the dielectric covering so as to impose no transversely inward force on the dielectric covering. Preferably, a clearance is formed between the shield and the dielectric covering, and the density of the braided shield is maximized to render it self-supporting. The outer dielectric jacket of the cable likewise loosely encircles the braided shield to eliminate frictional resistance to relative movement between the shield and jacket.

6 Claims, 1 Drawing Sheet

HIGHLY FLEXIBLE, SHIELDED, MULTI-CONDUCTOR ELECTRICAL CABLE

BACKGROUND OF THE INVENTION

The present invention relates to flexible electrical cables having braided wire shields surrounding an inner conductor assembly, and particularly to improvements to such cables which provide exceptional pliability and limpness for minimizing the resistance to movement imposed by such cables on devices to which they are attached.

Multi-conductor electrical cables having an inner conductor assembly with a dielectric covering surrounded by a braided wire shield, as shown for example in U.S. Pat. No. 4,552,989, are now in common use for rapidly transmitting signals to and from sophisticated electronic equipment. Although such cables are flexible, such flexibility is insufficient for certain applications. For example, when such cables are attached to hand-held devices such as medical diagnostic instruments, where maximum maneuverability of the devices is required, the limited flexibility of such cables can cause excessive resistance to movement of such devices in all directions, as well as excessive resistance to axial twisting of such devices.

Some cable designs, such as that shown in U.S. Pat. No. 3,665,096, have been developed to improve the flexibility of cables by eliminating the braided wire shield and substituting therefor more complex types of shields with lesser stiffness than a braided shield. However, such designs are not only substantially more expensive to manufacture, but fail to recognize that the stiffness of the shield itself is not the primary factor affecting cable flexibility.

Certain other types of electrical cables, such as those shown in U.S. Pat. Nos. 2,006,932, 2,234,675 and 2,866,843, provide spaces or clearances between various layered components of the cable to accommodate fluids for various purposes, but such spaces are not used in conjunction with braided wire shields nor are they effective to improve cable flexibility.

Coaxial cable transducers, as depicted in U.S. Pat. Nos. 3,763,482 and 3,921,125, have braided wire outer conductors snugly applied to the dielectric covering of an inner conductor with a capacitive gap (i.e. an effective electrical gap) between the outer conductor and the dielectric covering to provide a pressure-sensitive transducer action. However the snug application of the braided wire outer conductor prevents the braided wire and the dielectric material from moving freely in a longitudinal or rotational direction relative to each other, and thereby prevents the cable from attaining the high degree of flexibility or limpness needed for the special applications described above.

SUMMARY OF THE INVENTION

The principal object of the present invention is to overcome the foregoing deficiencies of the prior art by providing a multi-conductor electrical cable with braided wire shielding having substantially greater flexibility and limpness than has previously been possible. This is accomplished not by making the shield itself more flexible (in fact, it may be stiffer as explained hereafter), but rather by substantially eliminating frictional and other resistance to movement in axial and rotational directions between the shield and the adjacent components of the cable in the region between the ends thereof.

In order to eliminate such resistance to movement between the shield and the dielectric covering of the conductor assembly enclosed by the shield, the shield is braided loosely, rather than snugly, around the dielectric covering so that the braided wire of the shield applies substantially no force in a transversely inward direction against the dielectric covering substantially throughout its length, thereby minimizing frictional forces between the two elements. Preferably the shield is braided sufficiently loosely that an annular clearance or air space is formed between the shield and the dielectric covering substantially throughout the length of the cable.

In order to braid the wire shield loosely during initial manufacture, and to substantially maintain such looseness throughout subsequent use of the cable, the shield is preferably made more dense, and thus stiffer, than normal. Such increased densification of the shield renders it substantially self-supporting so that it does not readily apply inward pressure against the underlying dielectric covering when external stretching or bending forces, tending to make the shield contract inwardly, are applied during use. Although increasing the density and stiffness of the shield would seem to be counterproductive to the object of the invention, it has been found that the resultant minimization of the aforementioned frictional forces is far more important to the ultimate flexibility of the cable than is the relative stiffness of the braided wire shield. In the present invention, the increased density of the shield is preferably such that the shield covers at least about 95%, and more preferably approaching 100%, of the dielectric covering of the inner conductor assembly, as opposed to a conventional coverage of approximately 80%–85%, thereby also improving the effectiveness of the shield.

For cables having flexible dielectric jackets surrounding the braided wire shield, flexibility is further enhanced by substantially eliminating frictional and other resistance to axial and rotational movement between the jacket and the shield between the ends of the cable. This is accomplished by placing the jacket loosely about the shield such that the jacket applies substantially no force in a transversely inward direction against the shield substantially throughout the length of the cable and preferably forms an annular clearance or air space between the jacket and shield substantially throughout such length.

By means of the foregoing construction, the braided wire shield is substantially free to move either longitudinally or rotationally relative to the inner conductor assembly and outer jacket substantially throughout the length of the cable between its ends (even though no such freedom exists at the ends due to the cable terminating hardware). Such freedom of relative motion renders the cable exceptionally limp and pliable and thereby maximizes the freedom of movement of devices to which the cable is attached.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 1:
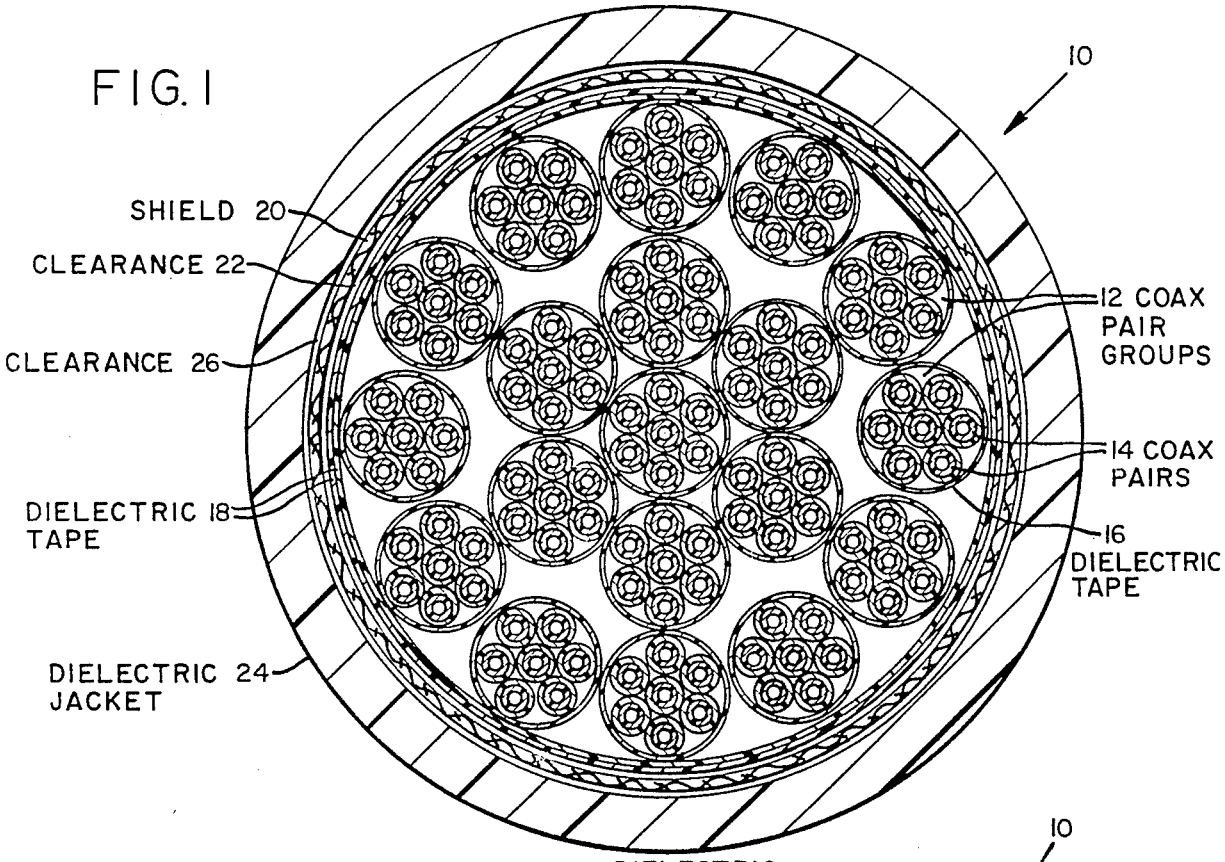
FIG. 1 is a cross-sectional view of an exemplary multi-conductor cable constructed in accordance with the present invention.
Figure 2:
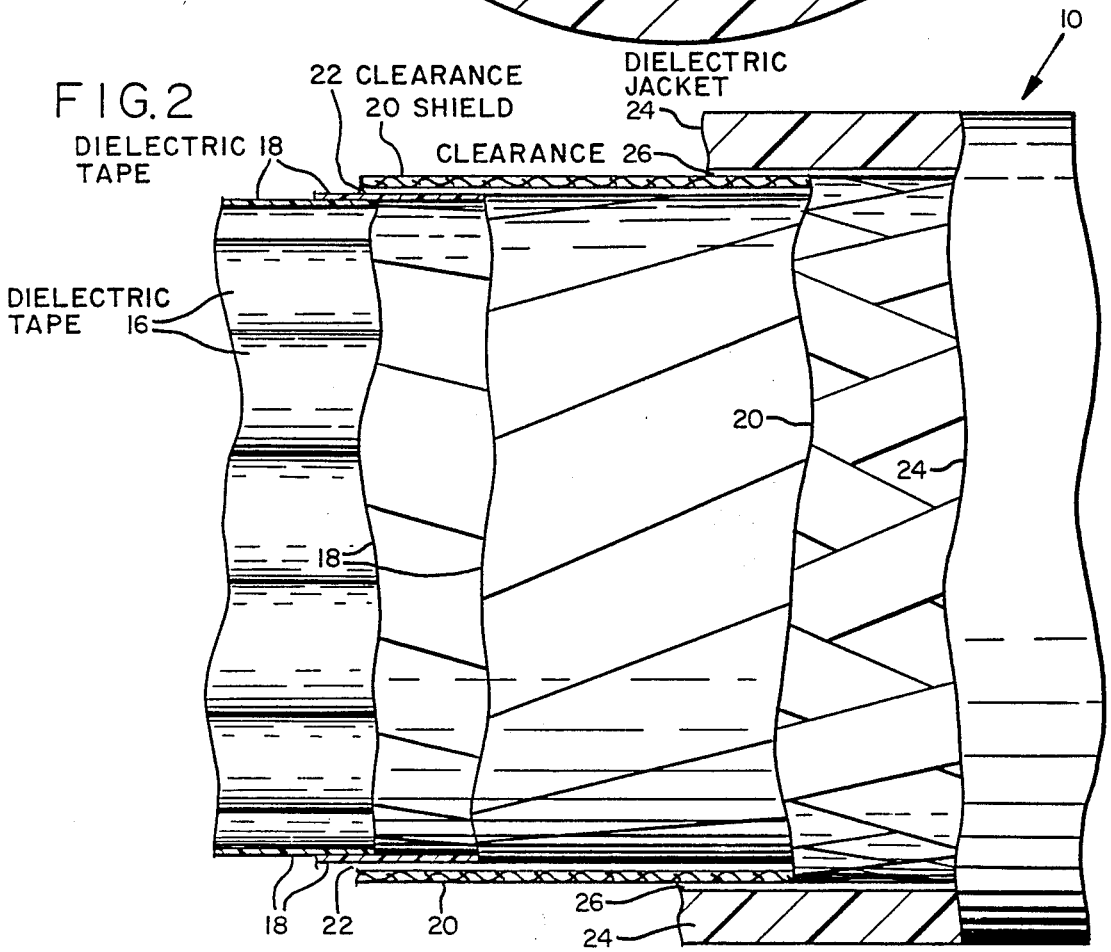
FIG. 2 is a side sectional view of a segment of the cable of FIG. 1 with the various layered elements of the cable successively cut away to reveal inner structure.

Referring to FIGS. 1 and 2, an exemplary multiconductor cable indicated generally as 10 includes an inner conductor assembly composed of multiple groups 12 of flexible miniature coaxial conductor pairs 14 of the general type described in the above-referenced U.S. Pat. No. 4,552,989, which is incorporated herein by reference. Alternative types of flexible conductors may also be used. Surrounding each group 12 of conductors is a sheath of flexible dielectric material 16, such as expanded PTFE tape of 0.002 inches radial thickness having a 50% nominal overlap. An outer flexible dielectric covering 18, consisting of a double layer of the aforementioned expanded PTFE tape or comparable dielectric material, surrounds the entire bundle of conductor groups 12.

Encircling the outer dielectric covering 18 of the inner conductor assembly is a flexible braided wire shield 20 composed of braided 38 AWG tin-plated copper wire. The shield 20 is braided loosely, rather than snugly, around the dielectric covering 18 during initial manufacture so as to apply substantially no force in a transversely inward direction against the dielectric material. This enables the braided shield 20 and the dielectric material 18 to be substantially free of resistance to movement relative to each other, either in a direction along the longitudinal axis of the cable 10 or in a rotational direction around such axis. Preferably the shield is braided sufficiently loosely to form an annular clearance or air space 22 between the shield and dielectric covering 18, the radial thickness of the clearance being about 1% to 4% of the outside diameter of the dielectric covering 18.

The foregoing relationship between the braided shield 20 and the dielectric covering 18 is achieved by adjusting a conventional wire braiding machine (such as that manufactured under the trademark WARDWELLIAN by the Wardwell Braiding Machine Co. of Central Falls, R.I.) so as to form a tubular cylindrical braid having an inner diameter greater than the actual outside diameter of the dielectric material 18 to be covered. Preferably the density of the braid is increased above the normal denisty by increasing the number of wires and decreasing their diameter so that the coverage by the shield of the dielectric material 18 is at least about 95%, and more preferably approaching 100%. Although the increased density of the braided shield 20 increases its stiffness, tending to detract from the objective of increased flexibility of the cable, such increased stiffness renders the braided shield self-supporting so that it need not rely on any forcible snug contact with the underlying dielectric covering 18 to prevent it from collapsing inward. After manufacture, when the cable is in use, the high density of the braided shield 20 tends to minimize any application of radially inward force by the shield 20 against the dielectric material 18 even under conditions of longitudinal stretching or bending of the shield. This is because any inward pressure by the shield against the dielectric material 18 would have to be accompanied by increased densification of the shield in the region of the pressure. If the density of the shield is already near maximum in the loose, asmanufactured state, no significant increased densification can occur except under relatively extreme external applications of force.

Accordingly, the substantial absence of frictional and other resistance to longitudinal or rotational movement between the braided wire shield and the underlying dielectric material 18 is maintained after initial manufacture and during actual usage of the cable. This freedom of relative movement is responsible for the enhanced flexibility and limpness of the cable in use, which minimizes the restraint which it might otherwise impose on the movement of hand-held or other devices to which it is attached.

Preferably the cable 10 is also provided with an outer flexible dielectric jacket 24, for example of PVC material. In such case, the jacket 24 likewise loosely encircles the braided shield 20 so as to apply substantially no force in a transversely inward direction against the shield, preferably forming a second annular clearance or air space 26 between the jacket and shield comparable in radial thickness to the clearance 22. This likewise renders the jacket and shield free of resistance to movement relative to each other in longitudinal and rotational directions to further enhance the flexibility of the cable for the reasons previously discussed.

Such relationship between the jacket 24 and braided shield 20 can be obtained, for example, by extruding the jacket, remotely from the other cable elements, with an inside diameter greater than the outside diameter of the braided shield 20. After the jacket is extruded and cured, it is cut to length and slipped loosely over the shield 20 of a corresponding length of the other cable elements. Although this method of jacket installation is discontinuous, as opposed to the more usual continuous method of extruding the jacket directly around the shield, it is more capable of insuring an accurate inside diameter of the jacket to insure looseness and it prevents any adhesion of the jacket to the shield which might otherwise occur if the jacket were extruded directly around the shield in an uncured state.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A highly flexible, shielded, elongate electrical cable comprising:

(a) flexible conductor means for conducting electrical current;

(b) flexible shield means for conducting electrical current, said shield means comprising braided strands of wire encircling said conductor means and electrically insulated therefrom;

(c) flexible material immediately underlying said shield means;

(d) said braided strands of wire loosely encircling said material immediately underlying said shield means and applying substantially no force in a transversely inward direction against said material immediately underlying said shield means.

2. The cable of claim 1, further including means defining a clearance between said braided strands of wire and said material immediately underlying said shield means.

3. The cable of claim 1 wherein said braided strands of wire cover at least about 95% of said material immediately underlying said shield means.

4. A method of making a highly flexible, shielded electrical cable comprising:

(a) providing an elongate, flexible, electrical conductor assembly having an outer surface of flexible dielectric material; and (b) braiding a flexible shield of electrically conductive wire around said conductor assembly so that said wire applies substantially no force in a transversely inward direction against the material immediately underlying said shield.

5. The method of claim 4, further including braiding said shield so as to form a clearance between said shield and the material immediately underlying said shield.

6. The method of claim 4, further including braiding said shield so as to cover at least about 95% of the material immediately underlying said shield.

* * * * *